United States Patent [19]

Persson et al.

[11] 4,076,468

[45] * Feb. 28, 1978

[54] MULTI-STAGE SCREW COMPRESSOR INTERCONNECTED VIA COMMUNICATION CHANNEL IN COMMON END PLATE

[75] Inventors: Walther Persson, Helsingborg; Lauritz Benedictus Schibbye, Saltsjo-Duvnas, both of Sweden

[73] Assignee: Svenska Rotor Maskiner Aktiebolag, Nacka, Sweden

[ * ] Notice: The portion of the term of this patent subsequent to Oct. 7, 1992, has been disclaimed.

[21] Appl. No.: 595,401

[22] Filed: Jul. 14, 1975

Related U.S. Application Data

[63] Continuation of Ser. No. 411,224, Oct. 31, 1973, Pat. No. 3,910,731, which is a continuation of Ser. No. 158,176, June 30, 1971, abandoned.

[30] Foreign Application Priority Data

Jul. 9, 1970 United Kingdom ..... 33405/70

[51] Int. Cl.[2] ..... F01C 1/16; F01C 11/00; F04C 23/00

[52] U.S. Cl. ..... 418/9; 418/97; 418/201

[58] Field of Search ..... 418/9, 97, 201-203

[56] References Cited

U.S. PATENT DOCUMENTS

| | | | |
|---|---|---|---|
| 2,481,047 | 9/1949 | Sloane | 418/199 |
| 2,691,482 | 10/1954 | Ungar | 418/9 |
| 3,093,300 | 6/1963 | Fraser | 418/9 |
| 3,209,990 | 10/1915 | Akerman | 418/9 |
| 3,307,777 | 3/1967 | Schibbye | 418/9 |
| 3,407,996 | 10/1968 | Oloffson et al. | 418/9 |
| 3,432,089 | 3/1969 | Schibbye | 418/201 |
| 3,677,664 | 7/1972 | Wycliffe et al. | 418/9 |
| 3,910,731 | 10/1975 | Persson et al. | 418/9 |

*Primary Examiner*—John J. Vrablik
*Attorney, Agent, or Firm*—Flynn & Frishauf

[57] ABSTRACT

Two stage screw compressor having two working spaces provided side by side with parallel axes within a common barrel member and extending in the same direction from a common plane surface of an end plate member in which one rotor of each stage are interconnected by a gear transmission including an input power shaft.

13 Claims, 6 Drawing Figures

2
2
3
3
4
4
10
12
14
16
18
20
22
22
24
24
26
28
28
30
32
34
38
66
68
74
78
82
84
86
88
90
92
94

MULTI-STAGE SCREW COMPRESSOR INTERCONNECTED VIA COMMUNICATION CHANNEL IN COMMON END PLATE

This application is a continuation of our copending application Ser. No. 411,224, filed Oct. 31, 1973, now U.S. Pat. No. 3,910,731, issued Oct. 7, 1975, which is a continuation of application Ser. No. 158,176, filed June 30, 1971, now abandoned.

This invention relates to a screw rotor machine for an elastic working fluid of the kind comprising a casing enclosing at least two working spaces, each generally comprising two intersecting bores having parallel axes and provided with barrel walls, with high pressure and low pressure end walls perpendicular to said axes and with high pressure and low pressure ports disposed in said walls, and a pair of intermeshing rotors respectively disposed in each working space, each rotor being provided with helical lands and intervening grooves and having a wrap angle of less than 360° and each pair of intermeshing rotors including one male rotor and one female rotor.

In such machines each male rotor has at least the major portion of each land and groove disposed outside the pitch circle of the rotor and the lands are formed with generally convex flanks while each female rotor has the major portion of each land and groove disposed inside the pitch circle of the rotor, and the lands are formed with generally concave flanks.

While in the following part of the specification the invention is described as applied to compressors it is obvious that it may also be applied to expanders. Eventhough the invention primarily is related to multistage compressors it can also be used for one stage compressors comprising two or more separate units acting in parallel.

Multistage compressors of the above general type have up to now been built in two different ways.

One way is to use a plant comprising separate one stage compressor units in series, which units are either completely independent from each other or driven by a common prime mover through an interconnecting transmission disposed in a separate transmission casing. A plant of such a type is known for instance from U.S. Pat. No. 3,407,996. In this patent is shown a compressor plant comprising two separate compressors, each of which is a complete unit including a casing providing barrel walls, high pressure and low pressure end walls of a working space in which the two intermeshing rotors are located. The two units are carried separately and spaced from each other by a common transmission casing, which casing per se does not in any way be in contact with the gaseous working fluid.

The other way frequently used for two stage compressors has been to design the compressor as a tandem plant in which at least the male rotors of the two stages have been arranged coaxially, and interconnected, and driven at the same speed of rotation from a common prime mover. Such tandem compressors are known for instance from U.S. Pat. Nos. 2,659,239, 3,093,300 and 3,265,292.

The tandem plant is much more compact than the plant having two separate units especially with respect to bulk, weight and manufacturing costs and also with regard to noise generation since the outer surface thereof is much smaller than that of the two unit plants which, moreover, must include noise emitting communication conduits between the different units.

The tandem plant, however, has some disadvantages owing to the fact that at least the two male rotors are coaxial and form a rigid rotor unit. Those disadvantages are (a) a long distance between the radial bearings of the rigid rotor unit resulting in a relatively large radial deflection, (b) only one thrust bearing for the rotor unit, resulting in a high loading thereof and in inaccurate axial clearances in the low pressure stage, (c) complicated and expensive manufacture of the rotor unit, (d) the same speed of rotation of the rotor unit in both stages resulting in difficulties in obtaining optimum tip speeds in both stages and a desirable volume ratio between the two stages with optimum wrap angles, lead angles and length to diameter ratio of each of the rotors. Furthermore, the intermediate wall separating the working spaces must be very accurately manufactured with parallel surfaces and the communication channels in order to obtain counter-directed thrust forces acting on the separate rotors to minimize the load of the thrust bearing, must be long and thus produce considerable losses.

The aim of the present invention is to produce a new type of screw rotor machine avoiding the disadvantages of the known types of machines mentioned above.

This new type of machine is a very compact machine having at least two separate working spaces disposed in parallel side by side in a casing comprising one common barrel member and at least one end plate member provided with a common plane surface constituting an end wall for each of the working spaces, and in which one rotor of each stage are interconnected by a power transmission disposed in a transmission chamber within said end plate member.

This new machine is especially advantageous when the two working spaces communicate through a communication channel provided within the end plate member thus eliminating all external piping and resulting noise production.

Tests have shown that in a two stage compressor unit with oil injection compressing air of atmospheric pressure with a total pressure ratio of 8:1 to 12:1 the ratio between the tip speeds of the male rotors in the low pressure stage and in the high pressure stage, respectively, should lie within the range 1.5:1 to 3:1 and preferably be about 2.2:1, which among others means that the noise deriving from the outlet of the high speed low pressure stage is effectively trapped by the low speed high pressure stage thus allowing only the working fluid of relatively low speed from the outlet of the second stage to pass into the oil separator with its large noise emitting surface, whereby a considerable reduction of the noise emission is achieved.

The tests referred to above have also shown that the male rotor tip speed of the high pressure stage should be extremely low for obtaining maximum efficiency and be of the order 7–15 m/s depending on the pressure ratio. According to the tests the optimum tip speed of the male rotor of the second stage will follow the formula $$s = c \cdot P_2/P_1$$

where $s$ is the tip speed in $m/s$, $c$ is a constant within the range 1 to 1.5, preferably about 1.25, and $P_2/P_1$ is the total pressure ratio of the compressor.

Furthermore the new type of machine opens up possibilities to simplify the design of the machine in many respects which reduces the costs for manufacture and maintenance.

Thus the transmission chamber can in a machine with oil injection form a part of the communication channel, whereby the gears of the transmission can be lubricated by the oil accompanying the working fluid, resulting in elimination of special means for this lubrication and reduction of the necessary channel area and consequently reduction of bulk, weight and cost.

The rotors of the two stages may further be of the same length so that both the end plate members of the casing may be provided with plane surfaces constituting the end walls of the working spaces. In combination with the fact that all rotors may have the same outer diameters additional advantages can be obtained. Thus the bores of the working spaces in the two stages will be exactly the same with the same centre distances, the rotors and also the bearings in the two stages will be exactly the same which not only simplifies production but also reduces the maintenance costs as the number of spare parts will be drastically reduced.

Moreover the fact that the working spaces are enclosed in a common barrel member results in a less bulky and lighter machine having a more rigid casing with smaller free surfaces which further reduces the noise emission.

Summing up it can be said that the machine, apart from the very high efficiency that can be obtained, will be less bulky with a reduction of the maximum volume by about 30% and at the same time the weight is considerably reduced compared with a corresponding tandem unit which up to now has been the most compact two stage machine for the same purpose.

These and other features of the invention will be clearly shown in the following detailed description of compressors comprising different embodiments of the invention shown in the accompanying drawings, in which.

Figure 1:
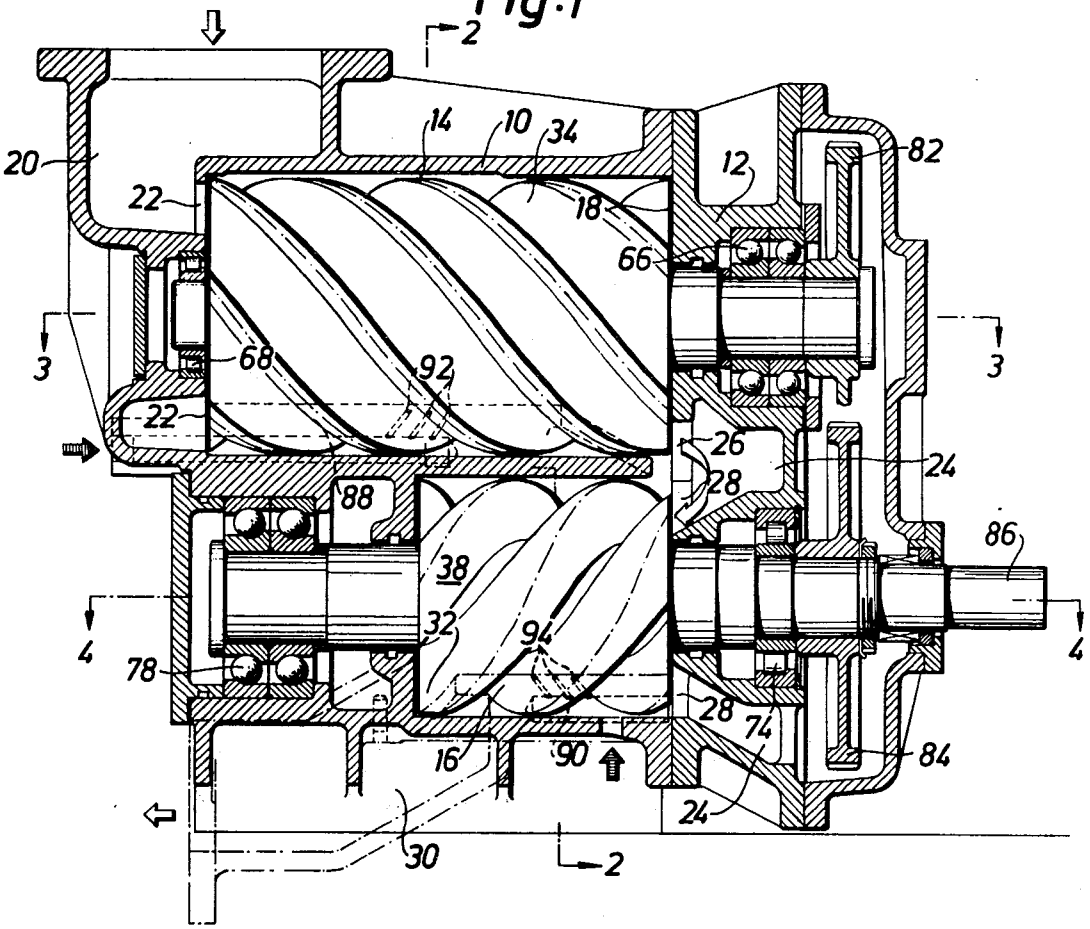
FIG. 1 shows a vertical longitudinal section through one form of compressor according to the invention taken along the line 1—1 in FIG. 2.
Figure 2:
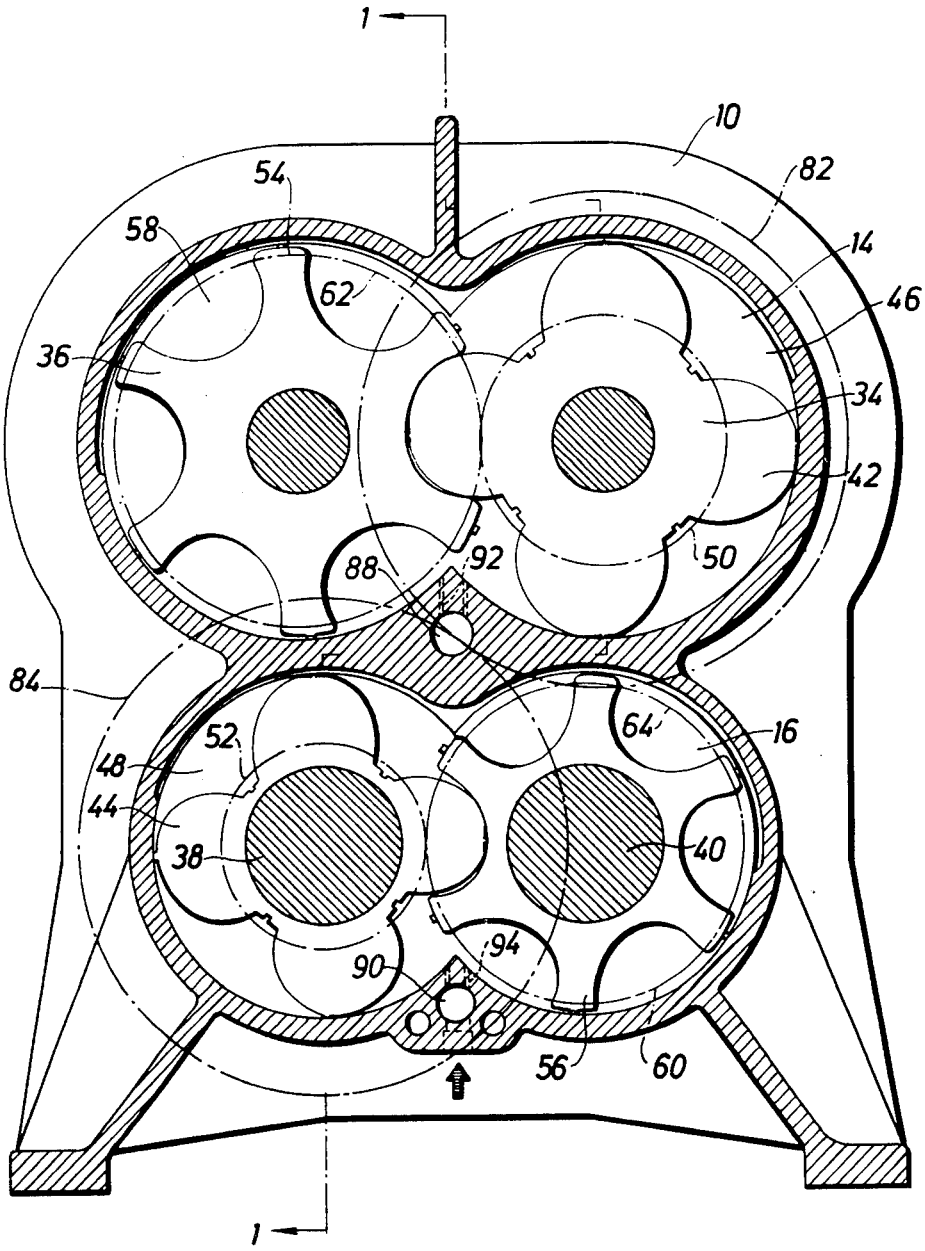
FIG. 2 is a section taken along the line 2—2 in FIG. 1.
Figure 3:
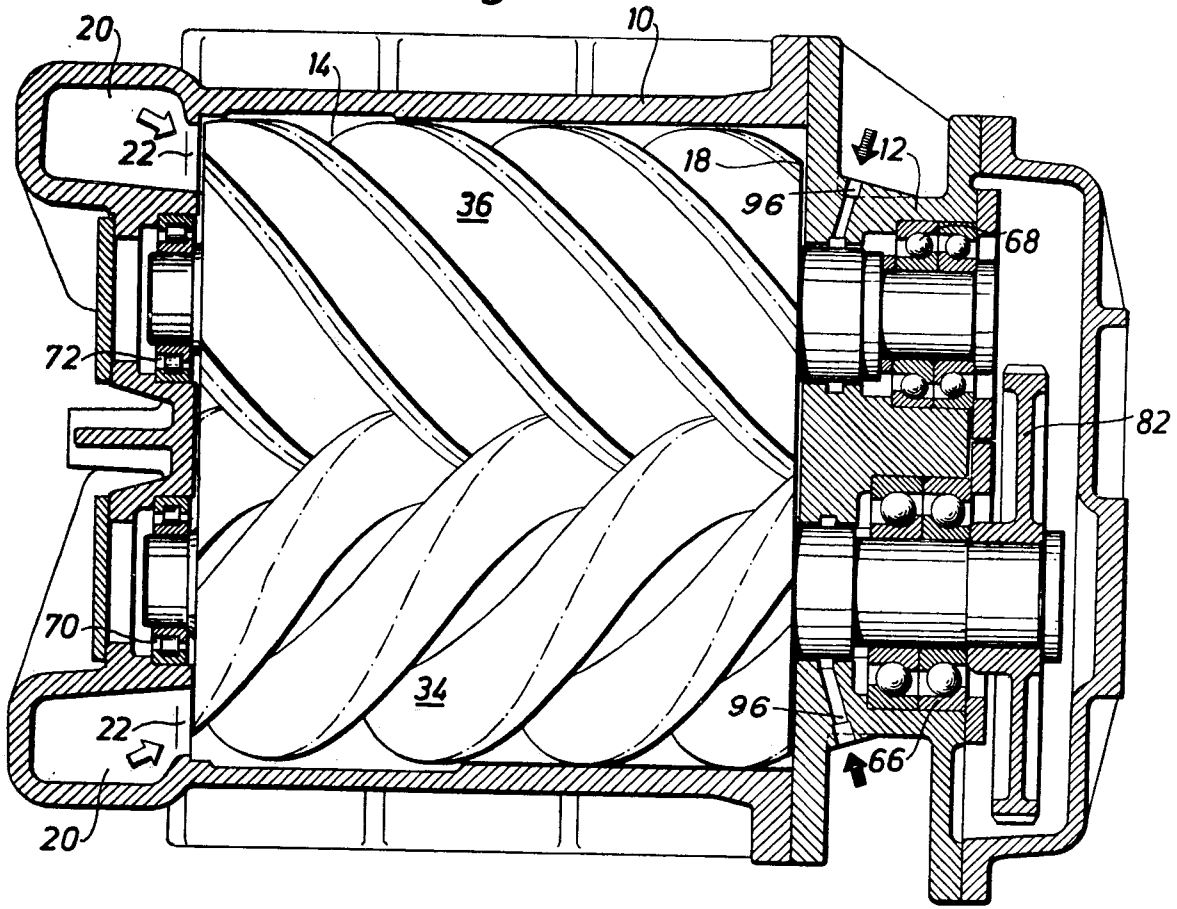
FIG. 3 is a section taken along the line 3—3 in FIG. 1.
Figure 4:
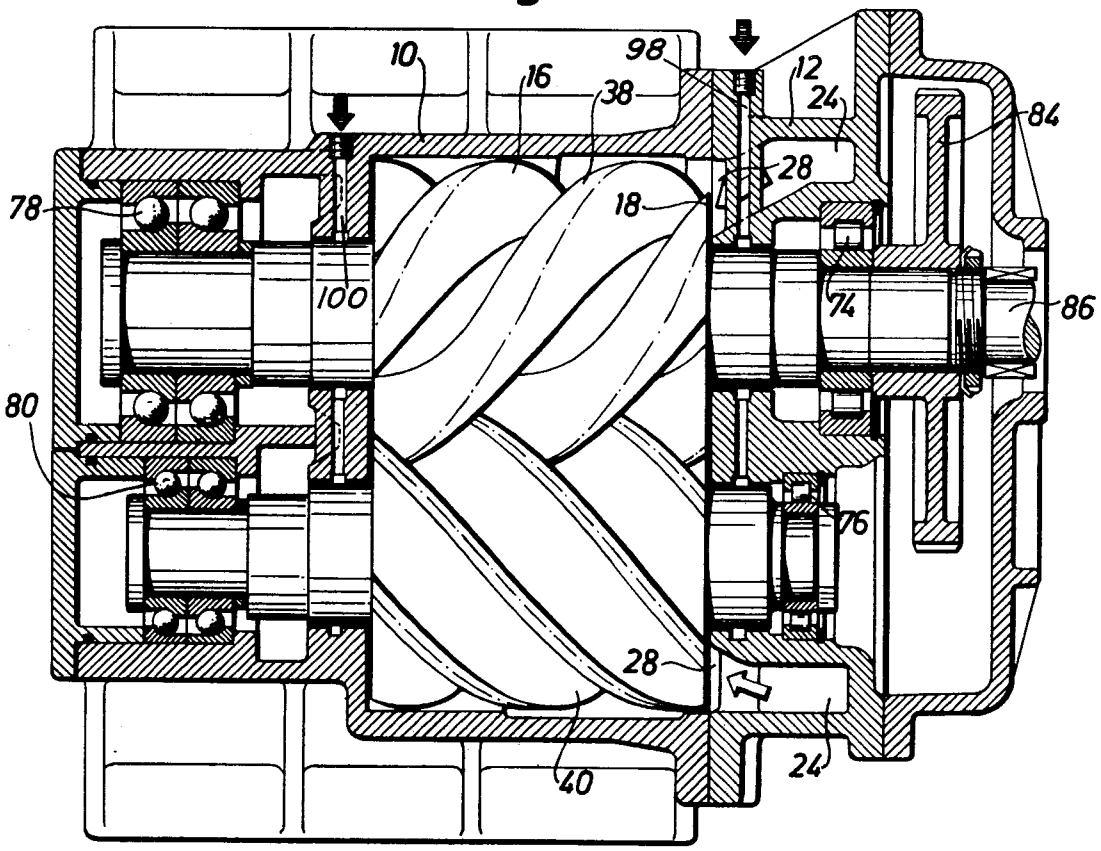
FIG. 4 is a section taken along the line 4—4 in FIG. 1.

The compressor shown in FIGS. 1 to 4 comprises a casing composed of a common barrel member 10 and of an end plate member 12 in which casing a low pressure working space 14 and a high pressure working space 16 are provided side by side within the common housing member 10. Each of said working spaces is generally composed of two intersecting bores with parallel axes. The working spaces 14, 16 project in the same direction from a common plane surface 18 of the end plate member 12 which surface constitutes the high pressure end wall of the low pressure working space 14 and the low pressure end wall of the high pressure working space 16. An inflow channel 20 is provided in the barrel member 10 communicating with the low pressure working space 14 through a low pressure port 22 thereof. A communication channel 24 is provided in the end plate member 12 communicating with the low pressure working space 14 through a high pressure port 26 thereof and with the high pressure working space 16 through a low pressure port 28 thereof. An outflow channel 30 is provided in the barrel member 10 communicating with the high pressure working space 16 through a high pressure port 32 thereof.

In each of the low pressure and high pressure working spaces 14, 16 a pair of intermeshing rotors 34, 36 and 38, 40, respectively, are mounted for rotation around parallel axes. One rotor 34, 38 of each pair is of male rotor type and provided with four helical lands 42, 44 with intervening grooves 46, 48 which have a wrap angle of about 300°. The lands 42, 44 have flanks the major portions of which are convex and located outside the pitch circle 50, 52 of the rotor and have a radial extent outside the pitch circle of about 19% of the outer diameter of the rotor 34, 38. The other rotor 36, 40 of each pair is of female rotor type and provided with six helical lands 54, 56 with intervening grooves 58, 60 which have a wrap angle of about 200°. The grooves 58, 60 have flanks the major portions of which are concave and located inside the pitch circle 62, 64 of the rotor. The profiles of the rotors are of the type shown for instance in U.S. Pat. No. 3,423,017 but also other types of rotor profiles can be used.

The rotors 34, 36 of the low pressure stage are mounted in combined radial and thrust bearings 66, 68 in the end plate member 12 and in radial bearings 70, 72 in the opposite end of the barrel member 10. The rotors 38, 40 of the high pressure stage are mounted in radial bearings 74, 76 in the end plate member 12 and in combined radial and thrust bearings 78, 80 in the opposite end of the barrel member 10. The low pressure male rotor 34 is outside the bearing 66 provided with a gear 82. The high pressure male rotor 38 is outside the bearing 74 provided with a gear 84 intermeshing with the gear 82 and mounted on a stub shaft 86 of the rotor 38 extending outside the end plate member 12 and adapted for connection with a prime mover, not shown. The gears 82, 84 are of helical type having lead angles such that some of the thrust forces of the high pressure male rotor 38 is transferred to the low pressure male rotor 34 thus attaining a reduction of the thrust forces of both the male rotors 34, 38.

In the barrel member 10 there are further provided chambers 88, 90 communicating with a pressure oil source not shown and injection holes 92, 94 forming communications between the chambers 88, 90 and the working spaces 14 and 16, respectively.

The barrel member 10 and the end plate member 12 are further provided with channels 96, 98, 100 (FIGS. 3 and 4) for supply of sealing oil around the shafts of the rotors 34, 36, 38, 40 at the high pressure end of the low pressure stage and at both ends of the high pressure stage.

The transmission 82, 84 is designed so that the tip speed of the male rotor 34 of the low pressure stage is higher than that of the male rotor 38 of the high pressure stage, and so that volume ratio between the swept volumes of the low pressure stage and of the high pressure stage, respectively, is about 2.5:1.

The compressor acts in the same manner as known compressors. However, owing to the short communication channel 24 and the minimum of change of direction of flow therein the losses are minimized and the efficiency is improved. The fact that the two male rotors 34, 38 are connected by means of gears instead of being rigidly interconnected means that the two rotors can be driven at different speeds so that the volumetric ratio and/or the volumetric capacity can be easily varied and also that an optimum peripheral speed can be used in each stage, which further improves the efficiency. Owing to the fact that the speed of the working fluid in the high pressure port 32 of the high pressure stage is relatively low the noise produced thereby is much lower than that of the working fluid passing out from a compressor of tandem type. The relatively high speed of the working fluid passing out through the high pressure port 26 of the low pressure stage does not produce any noise as the communication with the outlet channel 30 is effectively blocked by the high pressure stage and the overflow channel 24 is completely enclosed within the end plate member 12. Furthermore the noise emission from the compressor is considerably decreased as the surface of the casing and the maximum longitudinal extent thereof is drastically reduced in relation to a two stage tandem compressor. Owing to the very compact design of the compressor plant the bulk and the weight is decreased which in combination with the rather simple manufacture of the components of the plant results in a considerable reduction of the cost which considerably improves the capability of competing with other types of compressors.

Figure 5:
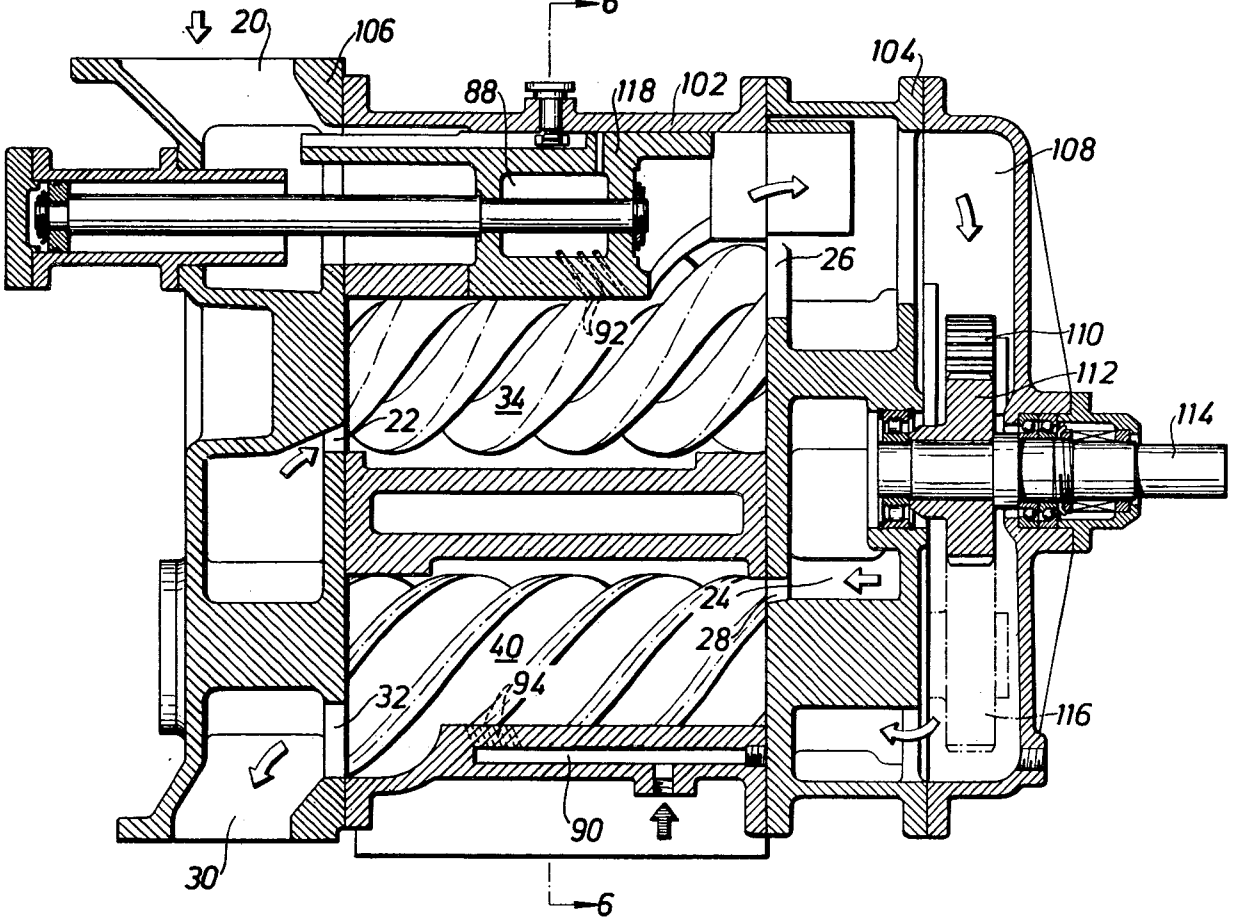
FIG. 5 shows a vertical section through another form of compressor according to the invention taken along the line 5—5 in FIG. 6.
Figure 6:
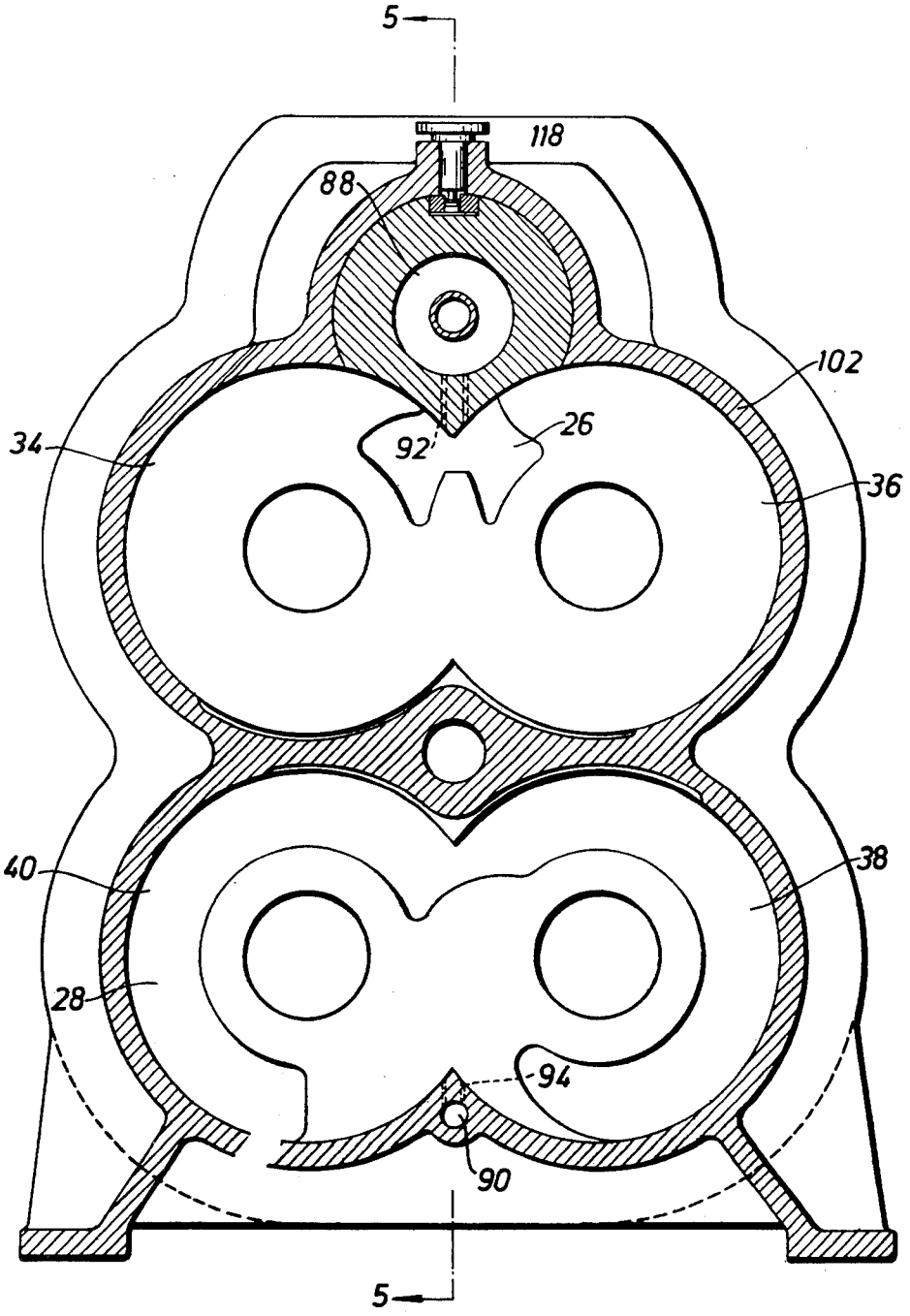
FIG. 6 is a section taken along the line 6—6 in FIG. 5.

The compressor shown in FIGS. 5 and 6 differs from the compressor shown in FIGS. 1 to 4 in the following way. The casing is composed of a barrel member 102 and two end plate members 104, 106, one 104 of which provides the communication channel 24 and a transmission chamber 108 communicating with the communication channel 24 enclosing a gear transmission comprising one gear 110 mounted on the low pressure male rotor 34, one gear 112 mounted on a separate input shaft 114, and one gear 116 mounted on the high pressure male rotor 38, the input gear 112 being in mesh with the gears 110 and 116 of the rotors 34, 38. Furthermore all rotors 34, 36, 38, 40 have the same lengths and the same diameters. Moreover a slidable valve member 118, of a type shown for instance in U.S. Pat. No. 3,314,597 is provided in the barrel wall of the low pressure working space 14 for variation of the volumetric capacity of the machine. The slidable valve member 118 is so disposed in the machine that it extends into the transmission chamber 108, when being in the position for minimum capacity.

While the shown compressors have been shown with oil injection it is obvious that this type of compressor may also be used with water injection. In such a case the compressor must be slightly changed by introduction of shaft seals and possibly also by introduction of synchronizing gears and by changing of the power transmission gear ratio. In a compressor of this type with water injection the amount of water injected into the low pressure stage may be so limited that all the unevaporated water will form a mist allowing practically the same rotor tip speed as that of a dry running compressor, whereas the amount of water injected to the high pressure stage may flood this stage resulting in a practically isothermic compression.

We claim:

1. Screw rotor machine for an elastic working fluid comprising:

casing means enclosing at least two working spaces, each generally comprising two intersecting bores with parallel axes and provided with barrel walls, with low pressure and high pressure end walls perpendicular to said axes, and with low pressure and high pressure ports disposed in said walls;

a pair of intermeshing rotors respectively disposed in each working space, each rotor provided with helical lands and intervening grooves having a wrap angle of less than 360°, each pair of intermeshing rotors comprising one rotor of male rotor type and one rotor of female rotor type, said rotors each including bearings mounted thereto; and a transmission chamber containing a power transmission provided with a power shaft extending externally of said casing means, one rotor of each stage being further interconnected by said power transmission disposed in said transmission chamber;

the improvement wherein the casing means comprises:

means defining at least two barrels immediately adjacent each other and respectively enclosing at least the major portions of said at least two working spaces in parallel side by side, said at least two barrels being rigidly coupled together at least at portions along the length thereof in the axial direction of said working spaces; and an end plate member directly connected to said means defining at least two barrels, said end plate member having:

one common plane surface defining an end wall of each of said working spaces;

means for removably connecting said end plate member to an end of each of said barrels of said means defining at least two barrels so that said common plane surface defines said end walls of said barrels;

means for removably receiving said bearings for all the rotors;

means for enclosing said transmission chamber; and channel means in said end plate member which form at least portions of a communication channel between said at least two working spaces, said channel means having at least two ports disposed in said common plane surface.

2. Machine as defined in claim 1, in which said end plate member is provided with an internal communication channel connecting two working spaces in series through the high pressure port of the low pressure stage and through the low pressure port of the high pressure stage, respectively.

3. Machine as defined in claim 2, in which means are provided for injecting liquid into at least one of said working spaces.

4. Machine as defined in claim 3, in which said transmission chamber forms a part of said communication channel.

5. Machine as defined in claim 4, in which an axially slidable valve is so provided in the barrel walls of the low pressure stage that in fully open position said valve extends into said transmission chamber.

6. Machine as defined in claim 3, in which said transmission is provided to give the male rotor of the low pressure stage a higher tip speed than that of the male rotor of the high pressure stage.

7. Machine as defined in claim 6, in which the ratio between the tip speeds of the male rotors of the low pressure stage and of the high pressure stage, respectively, lies within the range 1.5:1 to 3:1.

8. Machine as defined in claim 7, in which the ratio between the tip speeds of the male rotors of the low pressure stage and of the high pressure stage, respectively, is about 2.2:1.

9. Machine as defined in claim 7, in which the tip speed of the male rotor of the high pressure stage is defined by the formula $$s = c \cdot P_2/P_1$$

$s$ is the tip speed in m/s, $c$ is a constant within the range 1 to 1.5, preferably about 1.25, and $P_2/P_1$ is the total pressure ratio of the machine.

10. Machine as defined in claim 1, in which the length of the rotors are the same in the different working spaces.

11. Machine as defined in claim 10 acting as a compressor, in which the male rotor in one working space has the same diameter as that of the male rotor in another working space.

12. Machine as defined in claim 1, in which the power shaft of the transmission is coaxial with the axis of one male rotor and rigidly connected thereto.

13. Machine as defined in claim 12, comprising thrust bearings for said male rotors, and in which the male rotors carry directly intermeshing gears of the helical type having helix angles providing a distribution of the thrust forces between the thrust bearings for said male rotors.

* * * * *